US005245807A

United States Patent [19]

Ishimaru et al.

[11] Patent Number: 5,245,807

[45] Date of Patent: Sep. 21, 1993

[54] VIBRATION SUPPRESSING APPARATUS FOR A STRUCTURE

[75] Inventors: Shinji Ishimaru, Sohka; Takahiro Niiya, Funabashi; Kazuko Ishimaru, Sohka, all of Japan

[73] Assignees: Takenaka Corporation, Osaka; Tokyu Construction Co., Ltd., Tokyo, both of Japan

[21] Appl. No.: 895,023

[22] Filed: Jun. 8, 1992

[30] Foreign Application Priority Data

Jun. 11, 1991 [JP] Japan ..... 3-139252

[51] Int. Cl.[5] ..... E02D 27/34

[52] U.S. Cl. ..... 52/167 DF; 248/550; 248/559

[58] Field of Search ..... 248/559, 550; 188/378, 188/267, 151, 259; 267/136; 52/167 DF, 167 R

[56] References Cited

U.S. PATENT DOCUMENTS

| | | | |
|---|---|---|---|
| 1,761,322 | 6/1930 | Wells | 52/167 DF |
| 4,135,598 | 1/1979 | Stafford | 248/559 X |
| 4,483,425 | 11/1984 | Newman | 248/559 X |
| 4,635,892 | 1/1987 | Baker | 248/550 |
| 4,662,142 | 5/1987 | Weiner | 52/167 R |
| 4,807,840 | 2/1989 | Baker | 248/559 |
| 4,922,671 | 5/1990 | Sato | 52/167 DF |
| 4,924,640 | 5/1990 | Suizu | 52/167 DF |
| 5,005,326 | 4/1991 | Ishimaru | 52/167 DF |
| 5,025,599 | 6/1991 | Ishii | 52/167 DF |

FOREIGN PATENT DOCUMENTS

| | | | |
|---|---|---|---|
| 3037449 | 2/1991 | Japan | 52/167 DF |

*Primary Examiner*—J. Franklin Foss
*Attorney, Agent, or Firm*—Oliff & Berridge

[57] ABSTRACT

A weight is disposed in an arbitrary story of a structure so as to be movable relative to a direction of motion of the structure. Rotary members are supported in the weight. Rigid members meshing with gears provided on each rotary member are slidably fitted in the weight. These rigid members are respectively coupled to a ceiling and a floor via coupling members. The rotary members and the rigid members are disposed on the weight in correspondence with two horizontal directions. As a result, a horizontal motion of the floor of the structure is temporarily converted into a rotational motion by the rotary members, and is then converted into a horizontal motion so as to be transmitted to the ceiling. At this time, since the rotary members are pivotally supported in the weight, the weight can be moved in the opposite direction to that of the floor without undergoing an arcuate motion, thereby exhibiting the effect of reducing an input of vibration.

18 Claims, 10 Drawing Sheets

VIBRATION SUPPRESSING APPARATUS FOR A STRUCTURE

BACKGROUND OF THE INVENTION

1. Field of the Invention

The present invention relates to a vibration suppressing apparatus for a structure which is capable of suppressing the vibration of a structure caused by an earthquake, wind pressure, or the like.

2. Description of the Related Art

In the field of structural design, a vibration suppressing apparatus for suppressing the vibration of a structure with lever-weight mechanism has been proposed so as to improve dynamic properties of a conventional earthquake-proofing structure Japanese Patent Application Laid-Open No. 300540/1990).

This vibration suppressing apparatus is arranged such that a weight is pivotally attached to a distal end of a differential lever disposed in an arbitrary story of a structure, and the motion of the weight due to vibrations caused by an earthquake or the like is amplified by a lever ratio, thereby producing a large inertial force. The relative horizontal displacement of the main structure is offset by this inertial force, because the amplified inertial force can greatly consume kinetic energy caused by the earthquake of the like.

With the conventional vibration suppressing apparatuses, however, since the vibration suppressing direction is limited to one horizontal direction only in order to suppress the vibrations occurring in two horizontal directions due to the earthquake or the like, it has been necessary to provide two separate vibration suppressing apparatuses in the two horizontal directions (in the directions of the X and Y-axes). In addition, since the differential lever generally comprises a short arm, in length so as to give high stiffness it has been necessary to provide a pantograph or the like for preventing the arcuate motion of the weight attached to the distal end of the differential lever.

For this reason, the conventional vibration suppressing apparatuses experienced the drawbacks that the mechanism is complicated and the installation space becomes large.

SUMMARY OF THE INVENTION

In view of the above-described circumstances, it is an object of the present invention to provide a vibration suppressing apparatus for a structure with a lever-auxiliary mass mechanism which is capable of preventing the arcuate motion of a weight used as an auxiliary mass by a simple mechanism and of simultaneously suppressing the vibrations occurring in the structure in two horizontal directions.

The vibration suppressing apparatus for a structure in accordance with the present invention comprises: a mass supported so as to be movable relative to a direction of motion of the structure; first rigid members disposed in an upper portion of the mass in directions of two horizontal axes, respectively, and fitted slidably in the mass; second rigid members disposed in a lower portion of the mass in directions of two horizontal axes, respectively, and fitted slidably in the mass; rotary members pivotally supported in the mass and each having a large-diameter portion at one end of a rotating shaft and a small-diameter portion at another end of the rotating shaft, the rotary members being adapted to be movable together with the mass; and transmitting means for converting a horizontal motion of the second rigid member into a rotational motion to allow the rotational motion to be transmitted to one of the diameter portions of the rotary member, and for converting a rotational motion of the other one of the diameter portions into a horizontal motion to allow the horizontal motion to be transmitted to the first rigid member.

The vibrations of the induce structure in two horizontal directions during an earthquake or the like. These vibrations are transmitted from a lower portion to an upper portion of the structure. An amount of displacement of the structure is greater toward the upper portion of the structure than the lower portion of the structure with respect to the vertical axis of the structure.

Here, in accordance with the vibration suppressing apparatus for a structure having the above-described arrangement, as the second rigid members are coupled with the lower portion of the structure, the second rigid members are moved horizontally in the same direction by an amount of displacement which the lower portion of the structure undergoes. Assuming that the mass is fixed by some means the horizontal motion of each of the second rigid members is transmitted to one diameter-portion of the rotary member by the transmitting means, so as to rotate the rotary member. In addition, another diameter-portion, which is provided at the other end of the rotary member coaxially with a rotating shaft of the rotary member, also rotates. Here, owing to a ratio between the diameters of the diameter portions of the rotary member, a force which tends to move in the same direction as or in the opposite direction to the direction of displacement of the lower portion of the structure is generated in the rotating shaft of each rotary member pivotally supported in the mass. However, since the rotary member is pivotally supported by the mass, and actually the mass is supported on the lower portion of the structure so as to be relatively movable, each rotary member moves the mass in the same direction or in the opposite direction to the direction of displacement of the lower portion of the structure. At this time, since the first and second rigid members of the mass constitute a lever mechanism, the large movement of the mass consumes a large kinetic energy, thereby making it possible to exhibit the effect of reducing the vibration of the structure itself. In addition, since the rotary members cannot move in the vertical direction, no arcuate motion is produced in the mass. Thus the arcuate motion of the weight can be prevented by a simple mechanism, and the vibration of the structure occurring in two horizontal directions can be suppressed simultaneously.

The other objects, features and advantages of the present invention will become more apparent from the following detailed description of the invention when read in conjunction with the accompanying drawings.

DETAILED DESCRIPTION OF THE PREFERRED EMBODIMENTS

Figure 1:
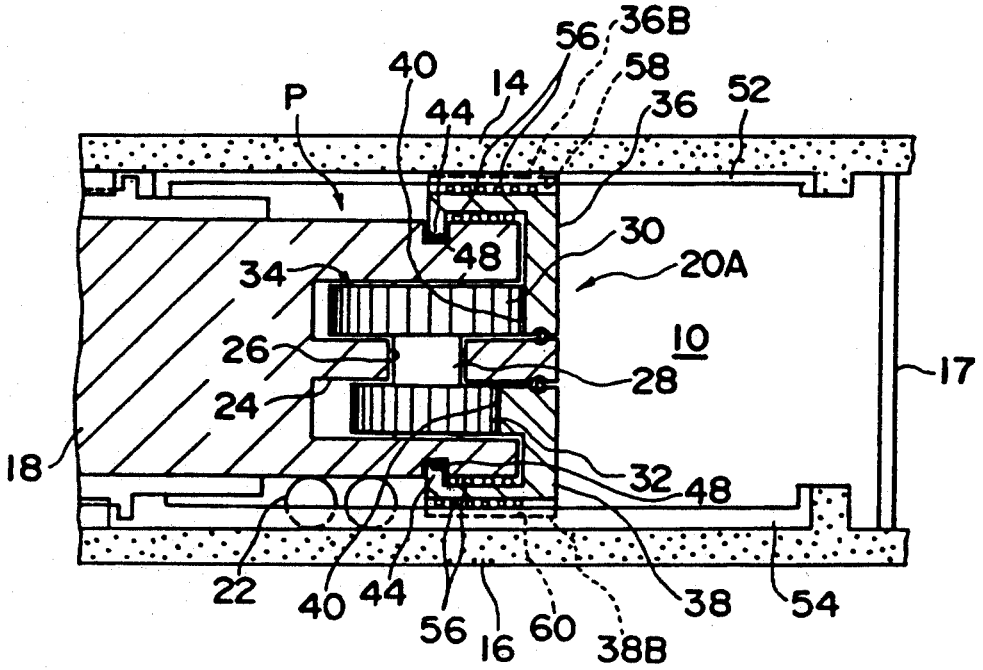
FIG. 1 is a cross-sectional view of a vibration suppressing apparatus for a structure in accordance with a first embodiment of the present invention.
Figure 2:
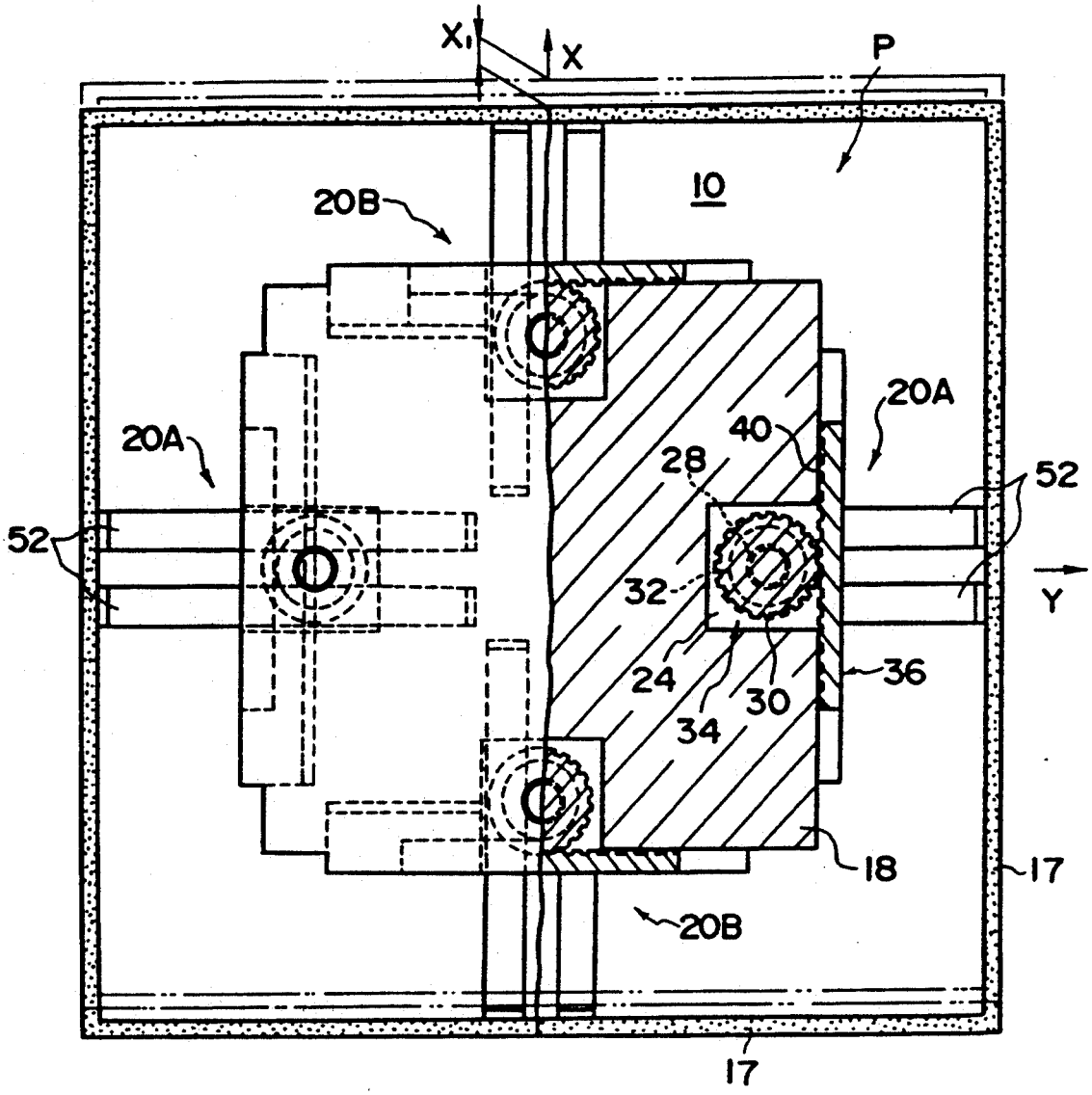
FIG. 2 is a plan view of the vibration suppressing apparatus for a structure in accordance with the first embodiment of the present invention.
Figure 3:
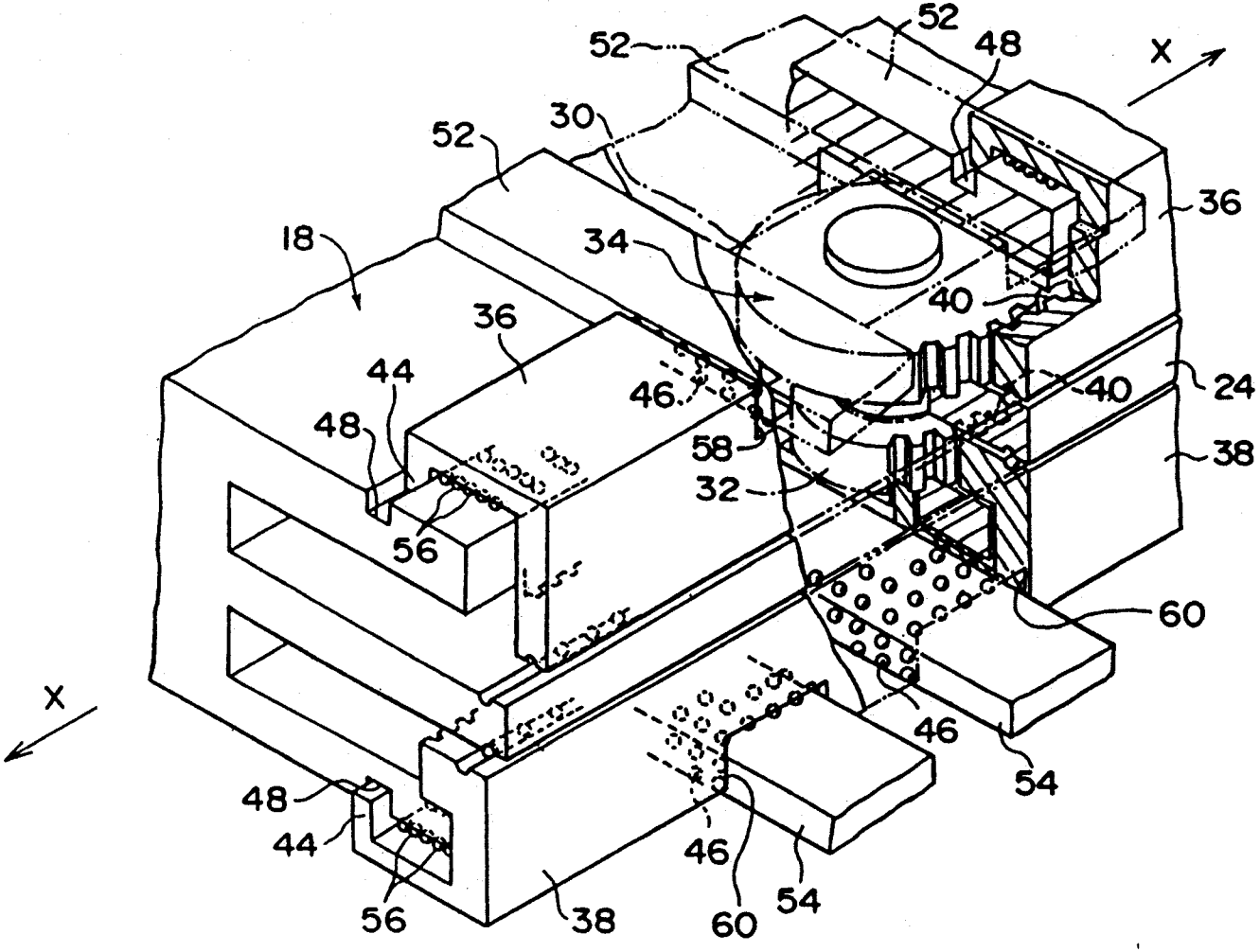
FIG. 3 is a perspective view illustrating a movably supporting section of the vibration suppressing apparatus for a structure in accordance with the first embodiment of the present invention.

FIGS. 1 to 3 show a vibration suppressing apparatus P for a structure in accordance with a first embodiment.

The vibration suppressing apparatus P is installed in an accommodation space 10 provided in an arbitrary story. This accommodating space 10 is provided between a ceiling 14 and a floor 16. The ceiling 14 and the floor 16 are coupled to each other by means of pillars 17 having low horizontal stiffness. As a result, the ceiling 14 and the floor 16 are movable relative to each other.

As shown in FIG. 1, a weight 18 serving as a mass is disposed in a central portion of the vibration suppressing apparatus P installed in the accommodation space 10. Disposed in central portions of the four sides of this weight 18, respectively, are two movably supporting sections 20A, for supporting the weight 18 such that the weight 18 is movable in the direction of the X-axis, and two movably supporting sections 20B, for supporting the weight 18 such that the weight 18 is movable in the direction of the Y-axis. Here, since the movably supporting sections 20A, 20B differ from each other only in the vibration-suppressing direction with respect to the X- and Y-axes, and their mechanisms are identical, a description will be given hereafter by citing as an example the movably supporting section 20A for moving the weight 18 in the direction of the X-axis.

In the movably supporting section 20A, spherical rollers 22 are disposed on the floor 16, as shown in FIG. 1, and support the weight 18 such that the weight 18 is movable relative to the floor 16 in the directions of the X- and Y-axes (see FIG. 2). As shown in FIG. 3, a pivotally supporting portion 24 is formed in a transverse direction of the weight 18 by being left uncut as transverse portions of the weight 18 on both sides of the pivotally supporting portion 24 are cut out. A circular hole 26 is bored in a central portion of this pivotally supporting portion 24, and a rotary member 34 is rotatably supported in the circular hole 26. This rotary member 34 is arranged such that a gear 30 with a radius R1 and a gear 32 with a radius R2 (<R1) are respectively secured to opposite ends of a shaft 28.

As shown in FIG. 1, these gears 30, 32 extend laterally of the side surface of the weight 18, and are respectively engaged with rigid members 36, 38, which are parts of the movably supporting structure 20A, serving as first and second rigid members and each having a substantially L-shaped cross section. As shown in FIG. 3, two racks 40 for respectively meshing with the gears 30, 32 and serving as transmitting means are formed on those portions of the rigid members 36, 38 that abut against the gears 30, 32. As a result, as the rigid member 36 moves in the direction of the X-axis, the rotary member 34 is rotated via the rack 40 and the gear 30. The torque of this rotary member 34 is transmitted to the rigid body 38 via the rack 40 and the gear 32, thereby moving the rigid member 38.

Meanwhile, a pair of bent portions 44 are respectively formed at the other ends of the rigid members 36, 38 in such a manner as to be bent toward the weight 18, and are fitted in guide grooves 48 formed in the upper and lower surfaces of the weight 18. As a result, the rigid members 36, 38 are relatively movable in the direction of the X-axis as long as being guided by the guide grooves 48. In addition, flat grooves 58, 60 are respectively formed in upper and lower surfaces of substantially L-shaped bottoms 36B, 38B of the rigid members 36, 38. The movement of the rigid members 36, 38 in the direction of the X-axis is prevented by reaction-force plates 52, 54 secured to the ceiling 14 and the floor 16, respectively, as shown in FIG. 1. Furthermore, rollers 46 are disposed in the reaction-force plates 52, 54 at positions where the reaction force plates 52, 54 abut against the substantially L-shaped bottoms 36B, 38B of the rigid members 36, 38. This permits the integral movement of the weight 18 and the rigid members 36, 38 in the direction of the Y-axis.

Next, a description will be given of the operation of the first embodiment.

It is now assumed that, as shown in FIGS. 1 and 2, the ceiling 14 has undergone a displacement Xl in the direction of the X-axis from the center axis of the structure owing to a vibration due to an earthquake or the like. Consequently, a force is transmitted to the rigid member 36 of the movably supporting section 20A by the reaction force plate 52 disposed on the ceiling 14, so that the rigid member 36 is moved by Xl. Since the rack 40 formed on the rigid body 36 meshes with the gear 30 of the rotary member 34, the gear 30 rotates by $\theta(\theta=X1/R1)$ assuming to condition that the weight 18 is fixed by some means. Meanwhile, the gear 32 secured coaxially to the shaft 28 also rotates by $\theta$. Accordingly, the rigid member 38 which has the rack 40 meshing with the gear 32 moves by X2 ($X2=R2\times\theta$) in the direction of the X-axis. As a result, the force is transmitted to the reaction force plate 54 coupled to the rigid member 38, so that the floor 16 moves by X2 in the direction of the X-axis from the center axis of the structure. Namely, the amount of relative displacement between the ceiling 14 and the floor 16 becomes X1-X2. Actually, the weight 18, which is movably supported on the floor 16 by the rollers 22, is moved by $-X2$ from the center axis of the floor 16 in the direction of the X-axis, in an opposite direction to the moving direction of the floor 16 if $R1>R2$, and in the same direction as the moving direction of the floor 16 if $R1<R2$.

Accordingly, a ratio $\beta 1$ (lever ratio) between the amount of movement of the weight 18 and the amount of relative displacement between the ceiling 14 and the floor 16 becomes $\beta_1=X2/(X1-X2)$.

This relationship also holds with respect to the movably supporting section 20B, i.e., with respect to the direction of the Y-axis.

Thus, in this embodiment, since the rotary members 34 are used, the amount of horizontal movement can be temporarily converted into a rotational motion, and this rotational motion can then be converted into a horizontal motion. Therefore, it is possible to prevent the arcuate motion of the weight 18 without using a pantograph or the like, and the vibration suppressing apparatus P can be made compact.

It should be noted that the characteristic of the motion of the structure provided with the weight 18 (auxiliary mass) is described below if the motion is expressed as a single degree of freedom system vibrating in the direction of the X axis only.

The mass of the weight is assumed to be $m^{d1}$, the lever ratio is $\beta_1$, the mass of the portion of the structure located above the ceiling 14 is $m_1$, the relative displacement between the ceiling 14 and the floor 16 is x, in the direction of the X-axis the displacement of the floor 16 is y, the damping coefficient is $c_1$, and the stiffness of the pillar 17 is $k_1$, an equation of motion of the structure i.e., the ceiling 14 becomes as follows:

$$(m_1+m^{d1}\beta_1^2)\ddot{X}+C_1\beta_1^2\dot{X}+k_1X=-(m_1m^{d1}\beta_1)Y$$

Since the displacement of the floor 16 can be intepreted as earthquake ground motions, it can be said that, the effective magnitude of an earthquake disturbance becomes $(m_1+m^{d1}\beta_1)/(m_1+m^{d1}\beta^{21})$. In other words, if this value is set to be smaller than 1, an input-reducing effect is imparted to the structure, and if $\beta_1$ is set to be greater than 1, the damping becomes $C_1\beta_1^2$, so that the vibration-damping effect can be amplified. In addition, if the vibration suppressing apparatus P in accordance with this embodiment is applied to a conventional base-isolated structure, it is possible to prevent laminated rubber from becoming substantially displaced.

Next, a description will be given of a second embodiment.

Figure 4:
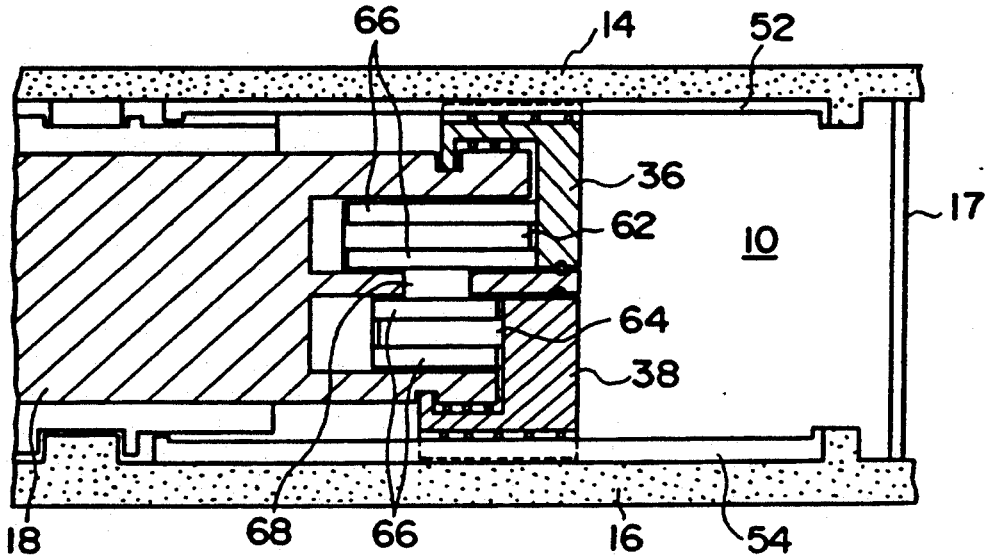
FIG. 4 is a cross-sectional view of a vibration suppressing apparatus for a structure in accordance with a second embodiment of the present invention.
Figure 5:
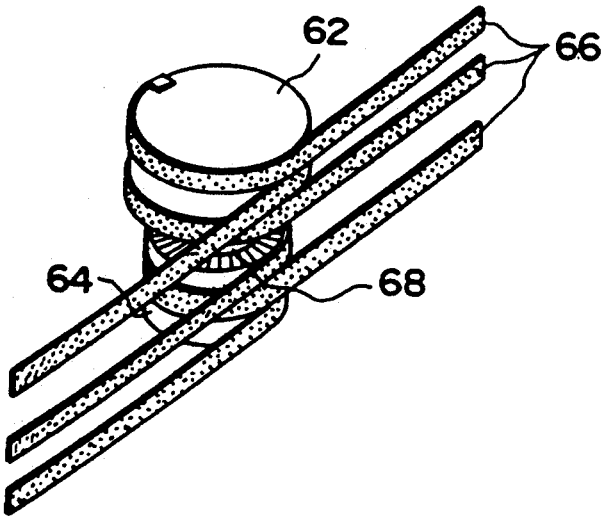
FIG. 5 is a perspective view illustrating a movably supporting section of the vibration suppressing apparatus for a structure in accordance with the second embodiment of the present invention.

As described above, in the first embodiment, a meshing arrangement including the gears 30, 32 and the racks 40 is used as the transmitting means for transmitting the motion of the rigid members 36, 38 to the rotary member 34. In the second embodiment, however, a belt transmission mechanism is used instead. Namely, as shown in FIGS. 4 and 5, belts 66 are wound around disks 62, 64, and opposite ends of the belts 66 are secured to the rigid members 36, 38. As a result, in the same way as in the first embodiment, as the rigid member 36 moves in the direction of the X-axis, the disk 62 is rotated via the belt 66. As the disk 64 secured to an identical shaft 68 is thereby rotated, the torque of the disk 64 is transmitted to the rigid member 38 via the belt 66, thereby moving the rigid member 38 in the direction of the X-axis.

It goes without saying that chains may be used instead of the belts 66.

Next, referring to FIGS. 6 and 7, a description will be given of the vibration suppressing apparatus P in accordance with a third embodiment. It should be noted that movably supporting sections 70A, 70B shown in FIG. 7 differ from each other only in the direction of suppression with respect to the directions of the X- and Y-axes, and that their mechanisms are identical. Therefore, a description will be given hereafter by citing as an example the movably supporting section 70A which permits the movement of the weight 18 in the direction of the X-axis.

Figure 6:
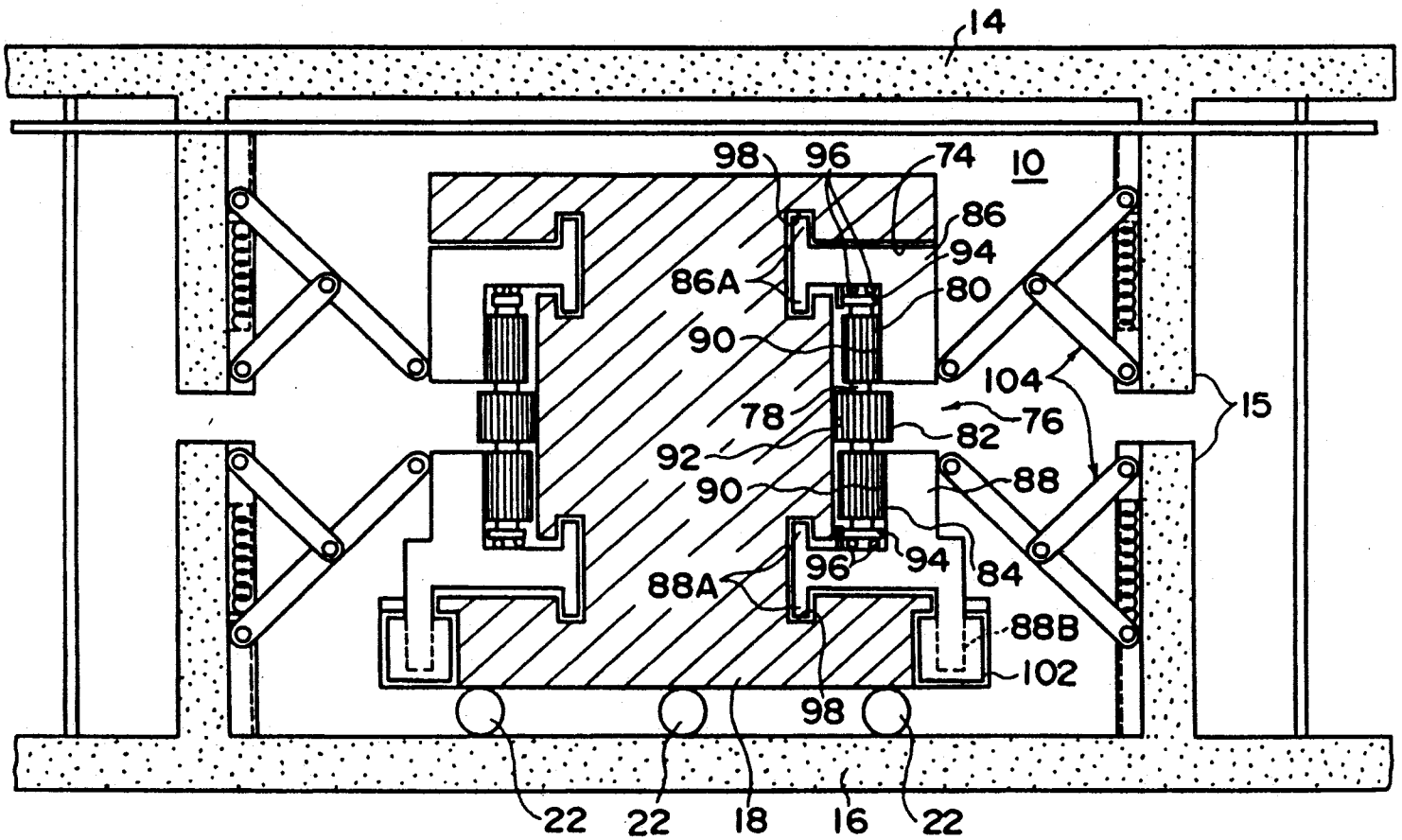
FIG. 6 is a cross-sectional view of a vibration suppressing apparatus for a structure in accordance with a third embodiment of the present invention.

In the movably supporting section 70A, the spherical rollers 22 are disposed on the floor 16, as shown in FIG. 6, and support the weight 18 such that the weight 18 is movable relative to the floor 16 in the directions of the X- and Y-axes. As shown in FIGS. 6 and 7, an accommodation portion 74 is formed in a central portion in a side surface of the weight 18 toward a central portion of the weight 18, and a rotary member 76 is accommodated therein. This rotary member 76 comprises a gear 80 with a radius R1, a gear 82 with a radius R2, and a gear 84 with a radius R3, which are secured to a shaft 78.

As shown in FIG. 6, the gears 80, 84 are respectively held by rigid members 86, 88 each having a substantially L-shaped cross section and extending along the side surface of the weight 18. As shown in FIG. 7, two racks 90 for respectively meshing with the gears 80, 84 are formed on those portions of the rigid members 86, 88 that abut against the gears 80, 84. As a result, the movement of the rigid member 86 in the direction of the X-axis is transmitted via the rack 90 and the gear 80 and causes the rotary member 76 to rotate. The torque of this rotary member 76 is transmitted to the rigid member 88 via the rack 90 and the gear 84, thereby moving the rigid member 88. In addition, the gear 82 meshes with a rack 92 formed in the weight 18 so as to render the weight 18 movable. Two rotary members 76 are provided in each of the movably supporting sections 70A. Opposite ends of the shaft 78 of each rotary member 76 are pivotally supported by plates 94, respectively. These plates 94 are movably coupled with the rigid members 86, 88 via rollers 96.

Two guide grooves 98 are formed in an innermost surface of the accommodating portion 74 so as to extend horizontally at upper and lower positions thereof, respectively. Projecting portions 86A, 88A of the rigid members 86, 88 extending horizontally at upper and lower positions thereof are fitted in the guide grooves 98. As a result, the rigid members 86, 88 are respectively guided by the guide grooves 98 and are thereby made movable in the direction of the X-axis. In addition, an anchor portion 88B extending downward from a lower portion of the rigid member 88 is formed, and is inserted in a viscous damper 102. Consequently, resistance proportional to the relatively moving velocity of the weight 18 is imparted to the rigid member 88.

These rigid members 86, 88 are coupled via a pantograph 104 to a rigid wall 15 disposed on the ceiling 14 or the floor 16. As a result, a force resulting from the relative movement between the ceiling 14 and the floor 16 is transmitted to the rigid members 86, 88 via the pantograph 104.

Next, a description will be given of the operation of the vibration suppressing apparatus P in accordance with the third embodiment.

Figure 7:
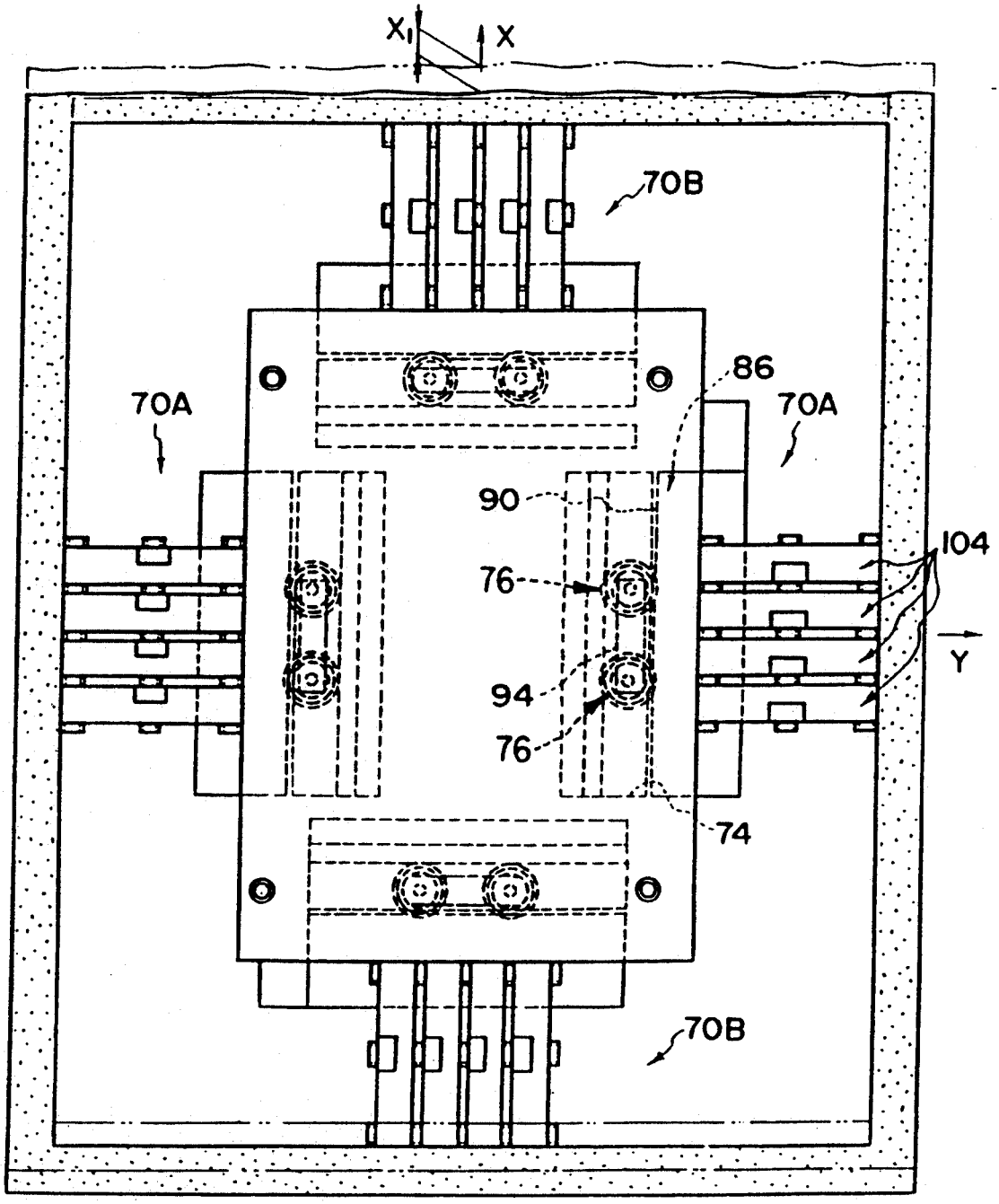
FIG. 7 is a plan view of the vibration suppressing apparatus for a structure in accordance with the third embodiment of the present invention.
Figure 8:
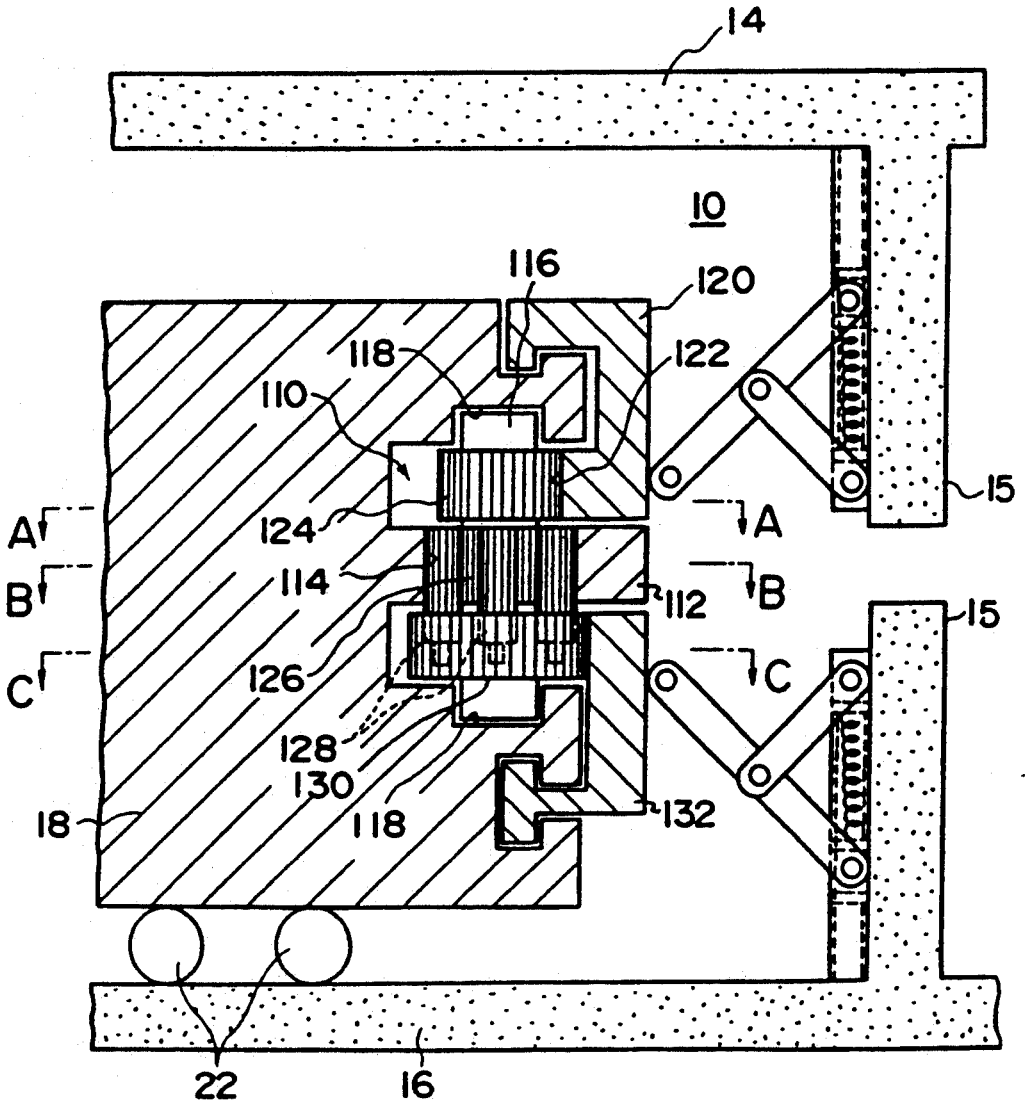
FIG. 8 is a cross-sectional view of a vibration suppressing apparatus for a structure in accordance with a fourth embodiment of the present invention.
Figure 9A:
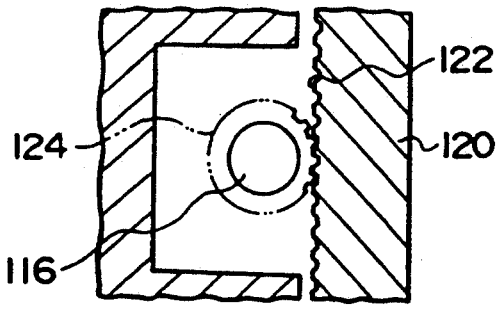
FIGS. 9A, 9B and 9C are cross-sectional views illustrating a rotary member of the vibration suppressing apparatus for a structure in accordance with the fourth embodiment of the present invention.
Figure 9B:
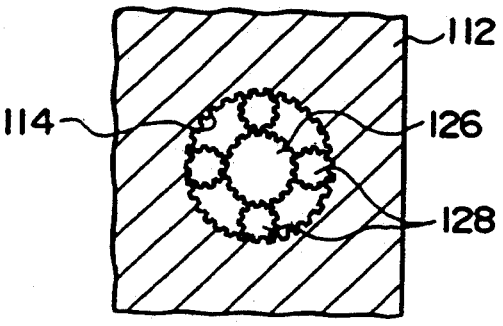
Figure 9C:
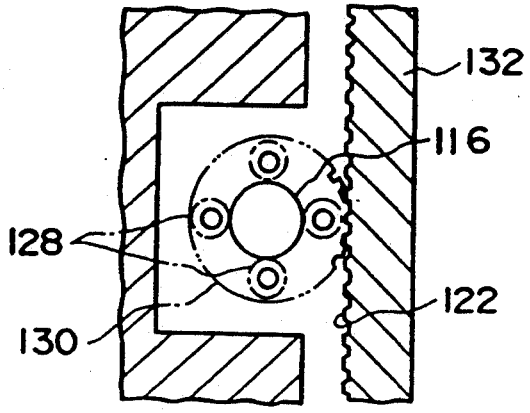

It is now assumed that, as shown in FIGS. 6 and 7, the ceiling 14 has undergone a displacement X1 only in the direction of the X-axis due to an earthquake or the like. Consequently, the rigid member 86 moves by Xl in the direction of the X-axis via the pantograph 104 disposed on the ceiling 14. At this time, since the gear 80 of the rotary member 76 meshes with the rack 90 formed on the rigid member 86, the gear 80 rotates by $\theta(\theta=X1/R1)$ assuming the rotary member 76 not to be shifted. Meanwhile, the gear 84 secured coaxially to the shaft 78 also rotates by $\theta$. Accordingly, the rigid member 88, on which the rack 90 meshing with the gear 84 is formed, moves by X3 ($X3=R3\times\theta$) in the direction of the X-axis. In addition, since the gear 82 also rotates by $\theta$, the weight also moves by $-X2$ ($-X2=R2\times\theta$) in the direction of the X-axis. Actually, since the rotary member 76 is designed to be movable, the ratio of relative displacement, $\beta 1$, between the rigid member 86 and the rigid member 88 with respect to the rotary member 76 becomes $\beta_1=-X3/(X1-X3)=-R3/(R_1-R_3)$, while the ratio of relative displacement, $\beta_2$, between the rigid member 86 and the rigid member 88 with respect to the weight 18 becomes $\beta_2=(-X3-X2)/(X1-X3)=(-R_3-R_2)/(R_1-R_3)$. Hence, the movement of the weight 18 is doubled, thereby enhancing the vibration suppressing effect.

A description will now be given of a fourth embodiment. As shown in FIGS. 8, 9A, 9B and 9C, a planetary gear mechanism is applied to a rotary member 110 in accordance with this embodiment.

A pivotally supporting portion 112 is formed in a side surface portion of the weight 18. A circular hole is formed in this pivotally supporting portion 112, and an internal gear 114 is formed on an inner surface of the circular hole. The rotary member 110 is held by this internal gear 114. An upper end of the rotary member 110 is pivotally supported in a shaft hole 118 formed in the weight 18. A gear 124, which meshes with a rack 122 formed on a rigid member 120, is secured to an upper end portion of a shaft 116, so as to convert the amount of movement of the rigid member 120 into an amount of rotation (see FIG. 9A). In addition, a sun gear 126 is formed at an intermediate portion of the shaft 116, and the sun gear 126 meshes with the internal gear 114 via planetary gears 128 disposed around the sun gear 126 (see FIG. 9B). Meanwhile, a lower end of the shaft 116 is pivotally supported in the shaft hole 118 formed in the weight 18. A ring-like gear 130 with a gear formed around it is disposed at a lower end portion of the shaft 116. An external gear of this ring-like gear 130 meshes with the rack 122 formed on a rigid member 132, so as to convert the rotational amount of the ring-like gear 130 into the amount of movement of the rigid member 132. In addition, the planetary gears 128 are rotatably supported by the gear 130, and are made free from the shaft 116 (see FIG. 9C).

Next, a description will be given of the operation of the fourth embodiment.

If it is assumed that the radius of the sun gear 126 is $r_a$, and the radius of each planetary gear 128 is $r_b$, an amount of rotation when the internal gear 114 is fixed and the ring-like gear 130 is made to undergo one revolution is shown in Table 1 below.

TABLE 1

| | Sun gear 126 | Planetary gear 128 | Gear 130 | Internal gear 114 |
|---|---|---|---|---|
| #1 | 1 | 1 | 1 | 1 |
| #2 | $\frac{r_a+2r_b}{r_a}$ | $-\frac{r_a+2r_b}{r_b}$ | 0 | −1 |
| Total | $\frac{2(r_a+r_b)}{r_a}$ | $-\frac{r_a+r_b}{r_b}$ | 1 | 0 |

Here, code #1 in Table 1 is a value of a rotational amount when the sun gear 126, the planetary gears 128, the internal gear 114, and the ring like gear 130 are fixed and are rotated clockwise. In addition, code #2 is a value of a rotational amount when the ring-like gear 130 is fixed and the internal gear 114 is made to undergo a counterclockwise revolution.

As a result, if it is assumed that the radius of the gear 124 is $r_1$, and the radius of the external gear of the ring-like gear 130 is $r_2$, a lever ratio $\beta$ thereof is expressed as follows:

$$\beta = \frac{-r_2}{\frac{2(r_a+r_b)}{r_a}r_1 - r_2}$$

Accordingly, in this embodiment, since the force transmitted from the ceiling 14 is amplified, it is possible to reduce the relative frictional force occurring between the weight 18 and the rollers 22, and to reduce the twisting moment acting on the shaft 116, by virtue of the presence of the planetary gears 128.

Figure 10:
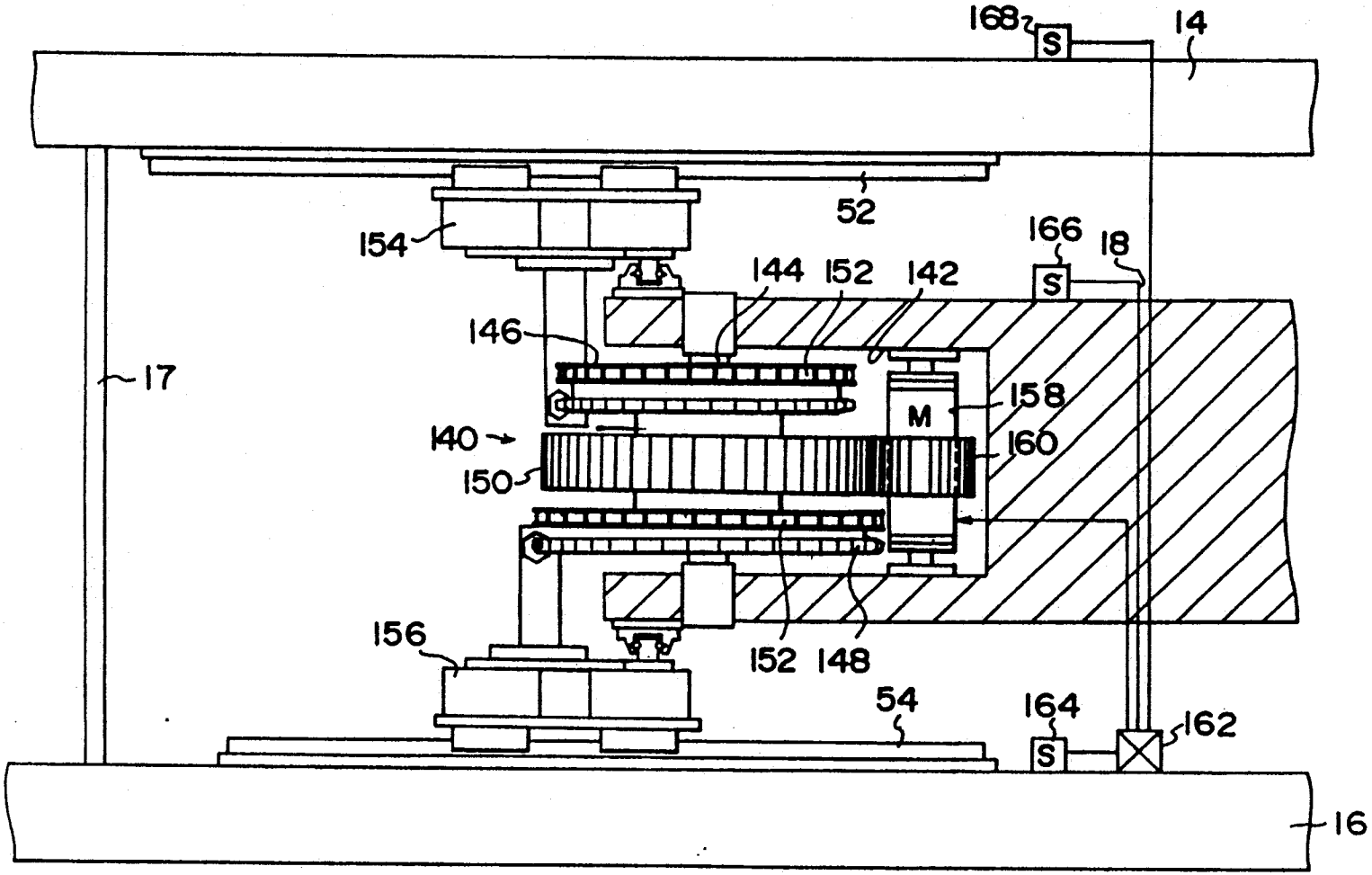
FIG. 10 is a cross-sectional view of a vibration suppressing apparatus for a structure in accordance with a fifth embodiment of the present invention.

Referring now to FIG. 10, a description will be given of a fifth embodiment.

The fifth embodiment is a modification of the third embodiment. A rotary member 140 is pivotally supported in an accommodating portion 142 formed in a side surface portion of the weight 18. This rotary member 140 comprises sprockets 146, 148, which are respectively secured to upper and lower end portions of a rotating shaft 144, and a large-diameter gear 150 secured to an intermediate portion of the rotating shaft 144. Chains 152 serving as the transmitting means are wound around the sprockets 146, 148, respectively. Opposite ends of the chains are secured to rigid members 154, 156, respectively. As a result, the torque of the rotary member 140 is transmitted to the rigid members 154, 156.

In addition, the gear 150 meshes a gear 160 which transmits the torque of a motor 158 which is secured in the accommodating portion 142. This motor 158 is connected to a controller 162.

Meanwhile, a sensor 164 is disposed on the floor 16, a sensor 166 is disposed on the weight 18, and a sensor 168 is disposed on the ceiling 14. All of the sensors are connected to the controller.

A description will now be given of the operation of the fifth embodiment.

Now, by paying attention to the direction of the X-axis only, the symbols are defined in the same way as in the first embodiment, and it is assumed that a moment M which forcibly causes a rotational angle $\theta$ in the rotary member 140 is being applied by the motor 158.

At this time, if the radii of the sprockets 146, 148 are defined to be $r_1$ and $r_2$, respectively, a relative displacement x between the ceiling 14 and the floor 16 is $(r_1-r_2)\theta$. Accordingly, an apparent force applied to the weight 18 through the rotary member 140 can be expressed as $M/(r_1-r_2)$, and this apparent force becomes a force which is newly applied by the motor 158. Hence, an equation of motor thereof becomes as follows:

$$(m_1+m_1{}^d\beta_1{}^2)\ddot{X}+C_1\beta_1{}^2\dot{X}+k_1X+M/(r_1-r_2)=-(m_1+m_1{}^d\beta_1)\ddot{Y}$$

Then, it is assumed that, for example, $d\dot{X}/dt$ and X are being detected by the sensors 164, 166, 168. Furthermore, it is assumed that the moment M to be applied forcibly is determined by the following formula using a control algorithm called a pole assignment method:

$$M/(r_1-r_2)=(\alpha-C_1\beta_1^2)\dot{X}+(k_2-k_1)X$$

If this formula is calculated by the controller 162 and the motor 158 is driven such that the calculated moment M will be produced, an equation at that time becomes as follows:

$$(m_1+m^{d1}\beta_1^2)\ddot{X}+\alpha\dot{X}+k_2X=-(m_1+m^{d1}\beta_1)\ddot{Y}$$

Namely, the damping coefficient is converted from $C_1\beta_1^2$ to $\alpha$, and the spring constant is converted from $k_1$ to $k_2$. Incidentally, if it is assumed that the radius of the large-diameter gear 150 is $r_3$, and a transmission force of the gear 150 isf when the gear 150 and the gear 160 mesh with each other for transmitting the torque of the motor 158 the following formula for the force f to be transmitted to this meshing point is expressed by the relationship of $M=f\cdot r_3$ by the following formula:

$$f=(r_1-r_2)\{(\alpha-C_1\beta 1^2)\dot{X}+(k_2-k_1)\dot{X}\}/r_3$$

As a result, it is possible to adjust the performance required for the motor 158.

Thus, it is possible to design a compact apparatus which can control in two directions the active control mechanism for reducing the response magnitude, while directly controlling the dynamic characteristics of the structure, by making use of an effective control algorithm.

It should be noted that, in the event that the motor 158 fails to be driven due to a power failure or the like, the motor 158 in this embodiment performs the function of a kind of damper when the gear 150 rotates.

What is claimed is:

1. A vibration suppressing apparatus for a structure comprising:

a mass supported so as to be movable relative to a direction of motion of said structure;

first rigid members disposed in an upper portion of said mass in directions of two horizontal axes, respectively, and fitted slidably in said mass;

second rigid members disposed in a lower portion of said mass in directions of two horizontal axes, respectively, and fitted slidably in said mass;

rotary members pivotally supported in said mass and each having a large-diameter portion at one end of a rotating shaft and a small-diameter portion at another end of said rotating shaft, said rotary members being adapted to be movable together with said mass; and transmitting means for converting a horizontal motion of said second rigid member into a rotational motion to allow the rotational motion to be transmitted to one of said diameter portions of said rotary member, and for converting a rotational motion of the other one of said diameter portions into a horizontal motion to allow the horizontal motion to be transmitted to said first rigid member.

2. A vibration suppressing apparatus for a structure according to claim 1, wherein said mass is supported by rollers so as to be movable on a floor of said structure.

3. A vibration suppressing apparatus for a structure according to claim 1, wherein said transmitting means comprises: a first gear disposed on said large-diameter portion, a rack formed on said first rigid member and meshing with said first gear, a second gear disposed on said small-diameter portion, and a rack disposed on said second rigid member and meshing with said second gear.

4. A vibration suppressing apparatus for a structure according to claim 1, wherein said transmitting means comprises: a first disk disposed on said large-diameter portion, a first belt wound around said first disk and having both ends coupled to said first rigid member, a second disk disposed on said small-diameter portion, and a second belt wound around said second disk and having both ends coupled to said second rigid member.

5. A vibration suppressing apparatus for a structure according to claim 1, wherein said transmitting means comprises: a first sprocket disposed on said large-diameter portion, a first chain wound around said first sprocket and having both ends coupled to said first rigid member, a second sprocket disposed on said small-diameter portion, and a second chain wound around said second sprocket and having both ends coupled to said second rigid member.

6. A vibration suppressing apparatus for a structure according to claim 1, further comprising: a first inertial-force transmitting plate for coupling an upper portion of said structure and said first rigid member and adapted to restrict movement of said first rigid member in a direction perpendicular to a sliding direction of said first rigid members; and a second inertial-force transmitting plate for coupling a lower portion of said structure and said second rigid member and adapted to restrict movement of said second rigid member in a direction perpendicular to a sliding direction of said second rigid members.

7. A vibration suppressing apparatus for a structure according to claim 1, further comprising: a first pantograph for coupling an upper portion of said structure and said first rigid member and adapted to restrict movement of said first rigid member in a direction perpendicular to a sliding direction of said first rigid members; and a second pantograph for coupling a lower portion of said structure and said second rigid member and adapted to restrict movement of said second rigid member in a direction perpendicular to a sliding direction of said second rigid members.

8. A vibration suppressing apparatus for a structure according to claim 1, wherein rollers are interposed between said first inertial-force transmitting plate and said first rigid member and between said second inertial-force transmitting plate and said second rigid member so as to allow said first and second inertial force members to be movable in sliding directions of said first and second rigid members.

9. A vibration suppressing apparatus for a structure comprising:

a mass supported so as to be movable relative to a direction of displacement of said structure;

first rigid members disposed in an upper portion of said mass in directions of two horizontal axes, respectively, and fitted slidably in said mass;

second rigid members disposed in a lower portion of said mass in directions of two horizontal axes, respectively, and fitted slidably in said mass;

rotary members each disposed rotatably between said first rigid member and said second rigid member and each having a large-diameter portion at one end of a rotating shaft and a small-diameter portion at another end of said rotating shaft;

gears each disposed at an intermediate portion of said rotating shaft and adapted to convert a rotational motion of said rotary member into a horizontal motion to allow the horizontal motion to be transmitted to said mass by meshing with said mass; and transmitting means for converting a horizontal motion of said second rigid member into a rotational motion to allow the rotational motion to be transmitted to one of said diameter portions of said rotary member, and for converting a rotational motion of the other one of said diameter portions into a horizontal motion to allow the horizontal motion to be transmitted to said first rigid member.

10. A vibration suppressing apparatus for a structure according to claim 9, wherein said transmitting means comprises: a first gear disposed on said large-diameter portion, a rack formed on said first rigid member and meshing with said first gear, a second gear disposed on said small-diameter portion, and a rack disposed on said second rigid member and meshing with said second gear.

11. A vibration suppressing apparatus for a structure according to claim 9, wherein said mass is supported by rollers so as to be movable on a floor of said structure.

12. A vibration suppressing apparatus for a structure according to claim 9, further comprising: a first pantograph for coupling an upper portion of said structure and said first rigid member and adapted to restrict movement of said first rigid member in a direction perpendicular to a sliding direction of said first rigid members; and a second pantograph for coupling a lower portion of said structure and said second rigid member and adapted to restrict movement of said second rigid member in a direction perpendicular to a sliding direction of said second rigid members.

13. A vibration suppressing apparatus for a structure according to claim 9, further comprising: a viscous damper coupled to a portion of said second rigid member and adapted to restrict the moving velocity of said second rigid member.

14. A vibration suppressing apparatus for a structure according to claim 9, wherein said rotary member has both axial ends pivotally supported by pivotally supporting members disposed in said mass.

15. A vibration suppressing apparatus for a structure according to claim 9, wherein a sun gear is formed in a central portion of said rotating shaft, and meshes, via planetary gears disposed around an outer periphery of said sun gear, with an internal gear formed in a circular hole, through which said rotary member is inserted, of said mass, the meshing of said sun gear and said internal gear converting a rotational motion of said rotary member into a horizontal motion of said mass.

16. A vibration suppressing apparatus for a structure comprising:

a mass supported so as to be movable relative to a direction of displacement of said structure;

first rigid members disposed in an upper portion of said mass in directions of two horizontal axes, respectively, and fitted slidably in said mass;

second rigid members disposed in a lower portion of said mass in directions of two horizontal axes, respectively, and fitted slidably in said mass;

rotary members pivotally supported in said mass and adapted to be movable together with said mass;

driving means for rotating said rotary members;

transmitting means for converting a rotational motion of said rotary member into a horizontal motion to allow the horizontal motion to be transmitted to said first rigid member and said second rigid member;

a first sensor for detecting an amount of a state of motion of a floor supporting said mass;

a second sensor for detecting an amount of a state of motion of said mass;

a third sensor for detecting an amount of a state of motion of a ceiling of said structure; and control means for controlling an amount of rotation of said rotary member by executing a predetermined calculation on the basis of output signals from said first sensor and said third sensor, and by backing up an amount of displacement of said mass by means of said second sensor on the basis of a value of said calculation.

17. A vibration suppressing apparatus for a structure according to claim 16, wherein said driving means comprises: a gear secured to an intermediate portion of said rotary member and a drive gear meshing with said gear and rotated by a motor.

18. A vibration suppressing apparatus for a structure according to claim 16, wherein said mass is slidably interposed between said first rigid member and said second rigid member.

* * * * *